US005951012A

United States Patent [19]

Feola

[11] Patent Number: 5,951,012

[45] Date of Patent: Sep. 14, 1999

[54] POKER GAMES

[76] Inventor: John Feola, 42 Irving St., Medford, Mass. 02155

[ * ] Notice: This patent is subject to a terminal disclaimer.

[21] Appl. No.: 08/948,996

[22] Filed: Oct. 10, 1997

Related U.S. Application Data

[63] Continuation-in-part of application No. 08/425,425, Apr. 20, 1995, Pat. No. 5,762,340.

[51] Int. Cl.[6] ..... A63F 01/00

[52] U.S. Cl. ..... 273/292; 273/274; 273/309

[58] Field of Search ..... 273/292, 293, 273/294, 296, 297, 149 R, 274, 309

[56] References Cited

U.S. PATENT DOCUMENTS

| | | | |
|---|---|---|---|
| 5,022,653 | 6/1991 | Suttle et al. | 273/292 |
| 5,248,142 | 9/1993 | Breeding | 273/292 |
| 5,257,789 | 11/1993 | LeVasseur | 273/292 |
| 5,265,882 | 11/1993 | Jones | 273/292 |
| 5,275,400 | 1/1994 | Weingardt et al. | 273/292 |
| 5,322,295 | 6/1994 | Cabot et al. | 273/292 |
| 5,382,025 | 1/1995 | Sklansky et al. | 273/292 |
| 5,653,444 | 8/1997 | Dahl | 273/292 |
| 5,762,340 | 4/1995 | Feola | 273/292 |
| 5,810,354 | 2/1997 | Banyai | 273/292 |
| 5,868,392 | 11/1997 | Kraft | 273/292 |

*Primary Examiner*—Jessica J. Harrison
*Assistant Examiner*—Sheila Clayton
*Attorney, Agent, or Firm*—Galgano & Burke

[57] ABSTRACT

The present invention provides for a poker game wherein the amount of successive wagers is pre-established. Each hand is preceded by players making at least one initial wager. A dealer also provides himself/herself with a plurality of cards and each player is displayed at least one card to form an initial partial hand. The players are given the opportunity to view their initial partial hands and are then required to increase their wagers by a predetermined amount in order to continue playing that hand. If the player increases his/her wager by the predetermined amount, then the player will be displayed at least one additional card. Various embodiments of the present invention require subsequent wagers in different amounts. For example, one embodiment requires a player to place two subsequent wagers in amounts equal to the player's initial wager in order to complete the hand. Alternative embodiments require players to make more than three subsequent wagers in equal amounts in order to complete the hand. Still other embodiments require players to make wagers in successively increasing amounts. Yet still other embodiments provide losing players with bonus payments based upon the ranking of a player's hand in combination with the player's ante.

26 Claims, 11 Drawing Sheets

FIG. 5

| 5 CARD STUD | | | |
|---|---|---|---|
| PROGRESSIVE STUD CHART WAGERS START FROM LEFT TO RIGHT | | | |
| 1st & 2nd Card | 3rd & 4th Card | 5 th Card | Total Dollars Wagered for All (7) Cards |
| $1 | $2 | $3 | 6 |
| 2 | 4 | 6 | 12 |
| 3 | 6 | 9 | 18 |
| 4 | 8 | 12 | 24 |
| 5 | 10 | 15 | 30 |
| 6 | 12 | 18 | 36 |
| 7 | 14 | 21 | 42 |
| 8 | 16 | 24 | 48 |
| 9 | 18 | 27 | 54 |
| 10 | 20 | 30 | 60 |

FIG. 6

| 7 CARD STUD | | | |
|---|---|---|---|
| PROGRESSIVE STUD CHART WAGES START FROM LEFT TO RIGHT | | | |
| 1st-2nd-3rd Card | 4th & 5th Card | 6th & 7th Card | Total Dollars Wagered for All (7) Cards |
| $1 | $2 | $3 | 6 |
| 2 | 4 | 6 | 12 |
| 3 | 6 | 9 | 18 |
| 4 | 8 | 12 | 24 |
| 5 | 10 | 15 | 30 |
| 6 | 12 | 18 | 36 |
| 7 | 14 | 21 | 42 |
| 8 | 16 | 24 | 48 |
| 9 | 18 | 27 | 54 |
| 10 | 20 | 30 | 60 |

POKER GAMES

This application is a continuation-in-part of U.S. patent application Ser. No. 08/425,425 filed Apr. 20, 1995 which issued as U.S. Pat. No. 5,762,340 on Jun. 9, 1998.

The present invention relates to poker games and, more particularly, poker games wherein players must increase their initial wagers by predetermined amounts in order to remain in a given hand.

BACKGROUND OF THE INVENTION

People have enjoyed playing poker-type games for many years. People particularly enjoy games which are interesting and exciting. When players are given the opportunity to wager on the outcome of a given poker hand, the games are usually considered more interesting. The level of interest will also typically increase as the amount wagered by the players increases.

One type of poker game which is particularly popular is stud poker. In various forms of stud poker, a player receives cards (or the electronic equivalent thereof) from a dealer and the player forms the best hand from his/her combination of cards according to a predetermined poker hierarchy. "STUD" poker is distinguished from "DRAW" poker which permits players to exchange one or more cards from the initially dealt hand for replacement cards. In STUD poker, a player must play the cards that the player is initially dealt.

Conventional games of DRAW poker require each player to make an initial bet, i.e. an "ante", and then provide players with the option of increasing the amount wagered before receiving a complete hand. In a conventional STUD poker game, the amount that a player may increase the wager may have a maximum limit but is typically not predetermined.

People desiring to participate in poker games at a casino or other gaming establishment can feel intimidated if they do not know the rules of the game. It would therefore be desirable to provide a novel poker game which offers the excitement of multiple wagers and requires players to make a number of decisions for each hand, but relieves players of the responsibility of determining the amount of their wager.

Another aspect of conventional casino poker games is the requirement that a plurality of players participate before the game commences. It would therefore be desirable to provide a poker-type game which permits play with a single player.

Since conventional games require all players in the game to play either five or seven-card versions of the game, it would also be desirable to provide players in the same game and playing the same hand, with the option of playing hands which utilize different amounts of cards (or the electronic equivalent thereof).

It would also be desirable to provide game layouts comprising indicia which indicate when and where wagers should be placed for inexperienced players.

It would also be desirable to provide a game which simplifies the player's decision as to the amount of wagers made following the initial wager(s).

SUMMARY OF THE INVENTION

The present invention provides for a device for playing a poker game wherein the amount of successive wagers is pre-established. Each hand is preceded by players making at least one initial wager. A dealer then provides himself/herself with a plurality of cards and each player with at least one card to form an initial partial hand. Although the dealer may receive his/her cards after the player, in some cases it may be desirable to have the dealer receive his/her cards first or simultaneously with the players. The players are given the opportunity to view their initial partial hands and are then required to increase their wagers by a predetermined amount in order to continue playing that hand. If a player increases his/her wager by the predetermined amount, then the player will receive at least one additional card either face-up or face-down depending upon the particular rules of the house.

Various embodiments of the present invention require subsequent wagers in different amounts. For example, one embodiment requires a player to place two subsequent wagers in amounts equal to the player's initial wager in order to complete the hand. Alternative embodiments require players to make more than two subsequent wagers in equal amounts in order to complete the hand. Still further embodiments require players to make wagers in successively increasing amounts.

Embodiments of the present invention permit players to play a poker-type game without requiring a plurality of players.

Still further embodiments of the present invention allow one or more players at a single table or station to play hands with different numbers of cards, even during the same hand.

Another advantageous aspect of the present invention is the provision of game boards which provide indicia for guiding players as to when wagers should be placed and how many cards a given wager will "buy" for a player.

According to another aspect of the present invention, a player is provided with a bonus award or payment under certain circumstances, such as if a player's hand matches the dealer's hand or the player's hand is one of a predetermined group of hands. The bonus award could be a set amount, an amount based on the player's ante, or a progressive jackpot.

These and other embodiments are described below with reference to the drawings.

BRIEF DESCRIPTION OF THE DRAWINGS

FIGS. 5 and 6 illustrate wagering charts used with an alternative embodiment of the present invention.

DETAILED DESCRIPTION

While apparently generally acceptable for their intended purposes, so far as is known, none of the prior art gaming devices afford an apparatus for playing a card game which comprises a mechanism for requiring at least one player to make at least one initial wager, a mechanism for providing a dealer with a plurality of cards face down, a mechanism for providing the player with at least one card to form an initial partial hand, a mechanism for subsequently requiring the player to place a second wager in an amount related to the initial wager by a predetermined multiple but unrelated to the amounts of the wagers of other players in order to continue playing the hand, a mechanism for providing the player with at least one additional card if the player increased the player's initial wager by the predetermined amount wherein different players are not required to wager the same amount, and a mechanism for comparing the dealer's hand with the player's hand according to a poker ranking and determining winning payouts based upon the comparison.

Embodiments of the present invention are directed to novel poker games which require players to place wagers in predetermined amounts, subsequent to placing an initial wager and before receiving cards necessary to complete the player's hand. According to the various embodiment of the present invention, if a player decides not to make a subsequent wager, the player automatically folds his/her hand and forfeits his/her opportunity to receive a winning payout for that hand and loses the ante and prior wagers. The players must therefore make decisions prior to receiving all of their cards.

Optionally, rather than folding and losing all wagers for the game, a player not wishing to continue in the game may "surrender", and forfeit only half of his/her wagers. Whether to allow a player to surrender is determined prior to the game. Whether all or only a portion of the ante is forfeited is also determined prior to the game.

Preferably, the rules of standard poker apply to determine the winning hands. The standard ranked poker hands, from best to worst, are a royal flush, straight flush, four of a kind, full house, flush, straight, three of a kind, two pair, one pair, and highest cards. This is the normal order used to rank hands. However, the present invention contemplates that any ranking order may be selected. Additionally, if more than five cards are used to determine the best-ranked hand, more and different combinations are included in the ranking. For example, if six cards are used to determine the best-ranked hand, a hand may include two sets of three of a kind, which is not a standard ranked hand. Optionally, "wild cards" may be used in determining the ranking. The cards that act as wild cards are selected before the game begins. "Jokers" may be included in the deck as wild cards.

Figure 1:
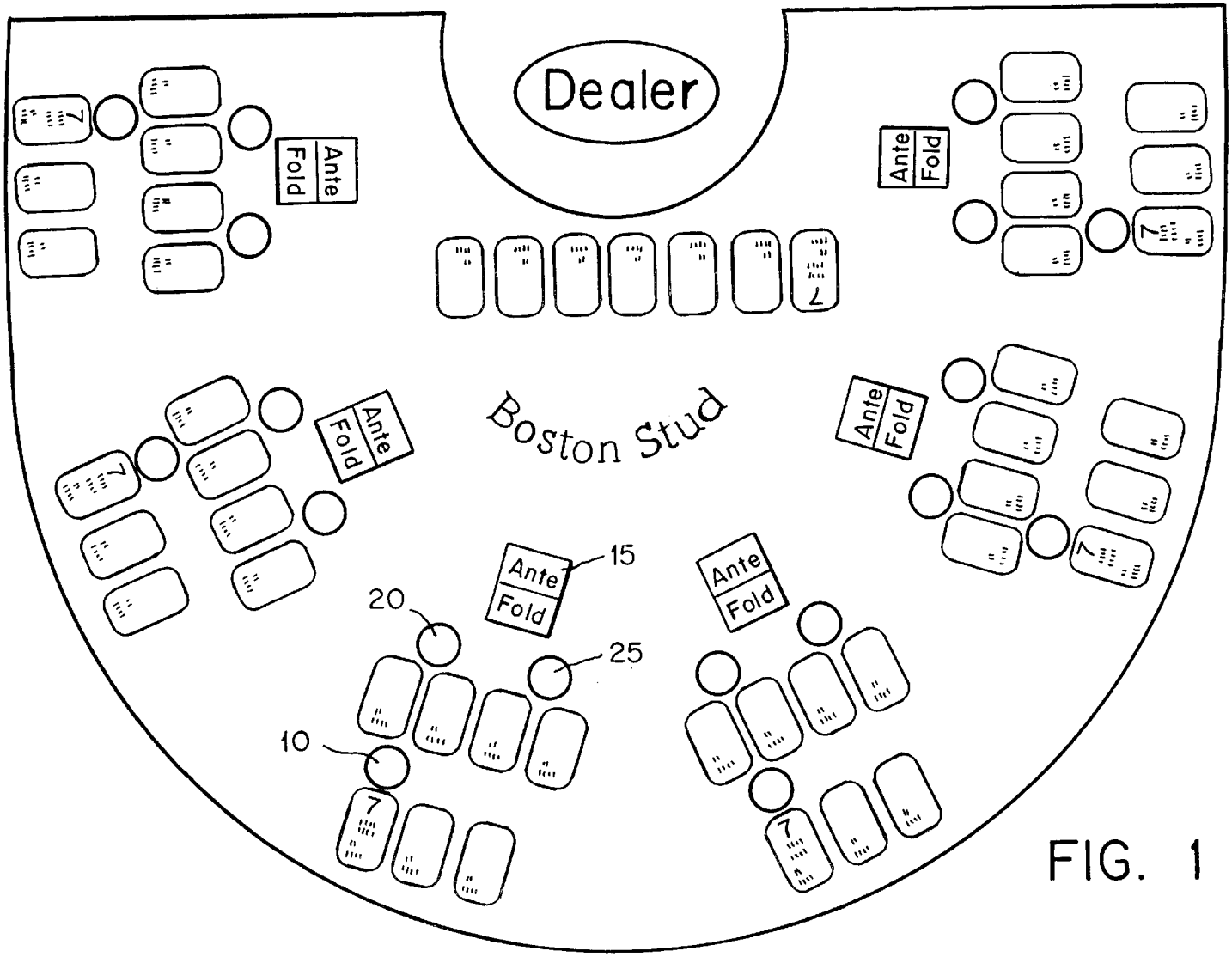
FIG. 1 illustrates a game board embodiment of one seven-card version of the present invention.
Figure 2:
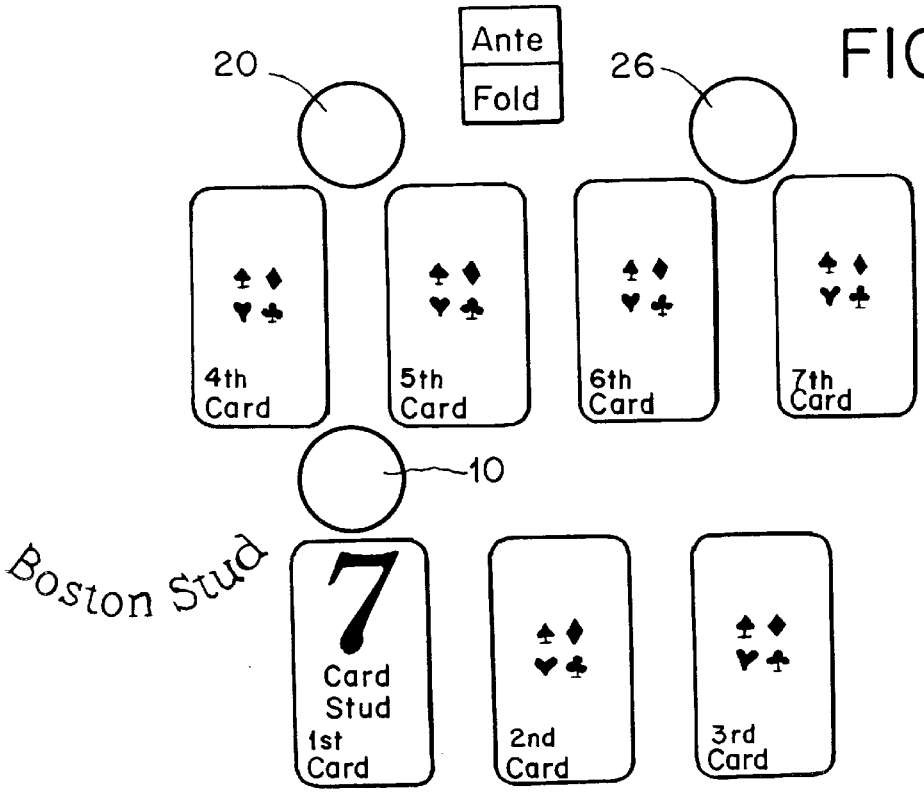
FIG. 2 illustrates a player's betting station in the embodiment illustrated in FIG. 1.

FIGS. 1 and 2 illustrate a seven-card version of one embodiment of the present invention wherein players are required to make a first wager by placing that wager in a first wager area 10. In the illustrated embodiment, the first wager is placed in a circular wager area 10 above the first card. An option that may be used with this embodiment of the present invention is to also require players to place an ante in a predetermined amount in the "ante" box 15 before play commences.

After the player has placed a first wager in the first wager area 10, the player receives three cards and the dealer is dealt three cards face down. The player is then permitted to view his/her cards but is not permitted to reveal his/her down cards to other players. After viewing his/her first three cards, the player has the option of folding or placing a second wager in wager area 20 located above the fourth and fifth card areas. If the player does not choose to make a second wager, his/her hand is folded and the ante and all previous wagers are forfeited. If the player does place a wager in second wager area 20, the player and the dealer receive two additional cards according to this embodiment. The cards can be dealt to the player either face-up or face down depending upon the particular rules of the house. The player is then again given an opportunity to review his/her cards and decide whether to fold or to place a third wager in third wager area 25. If the player fails to make the third wager in wager area 25, then the player's hand is folded and the player forfeits the ante and all wagers and his/her right to receive a winning payout during that hand. If the player makes a third wager in wager area 25, the player's and the dealer's hands are completed with sixth and seventh cards. Again the cards can be dealt to the player either face-up or face down. The player then qualifies for receiving a winning payout which is determined by comparing the player's best five cards according to some predetermined ranking of poker hands with the best 5 cards of the dealer's hand after all hands have been dealt. For example, winning hands can be determined using a standard poker hand hierarchy, or, alternatively, lower hands can win. The dealer's cards are only revealed after all players have completed their hands or folded. According to this embodiment of the present invention, the dealer uses a single deck of standard playing cards and pays winning hands in an amount equal to the amount wagered. It is within the scope of the present invention to use multiple decks of playing cards and may vary the odds of winning payouts as desired.

Figure 4:
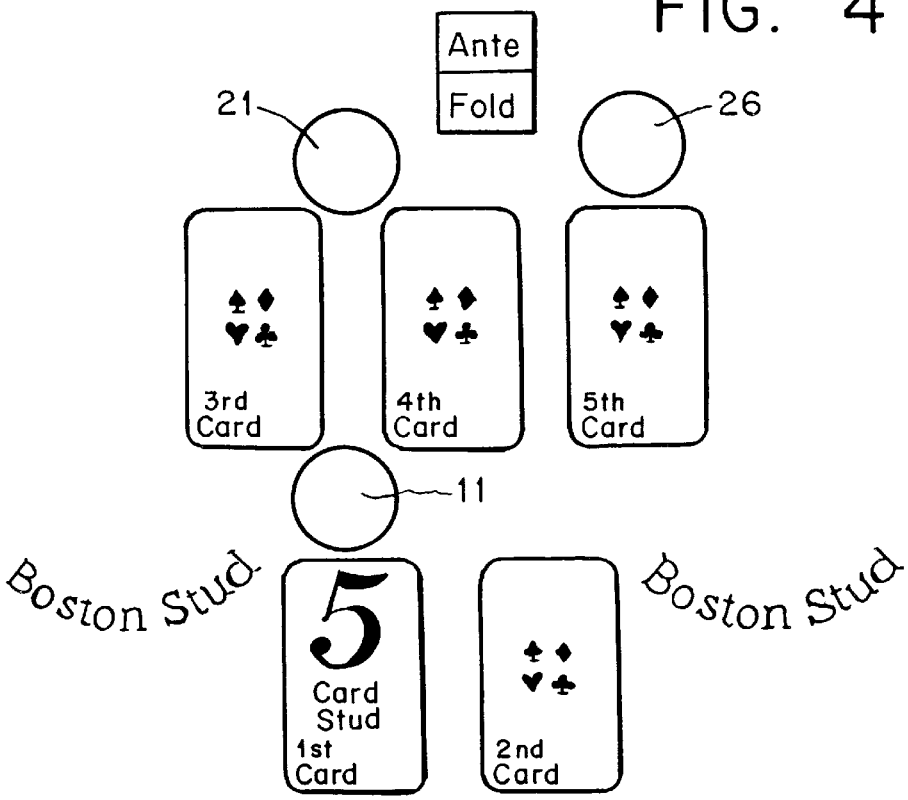
FIG. 4 illustrates a player's station of the embodiment illustrated in FIG. 3.
Figure 3:
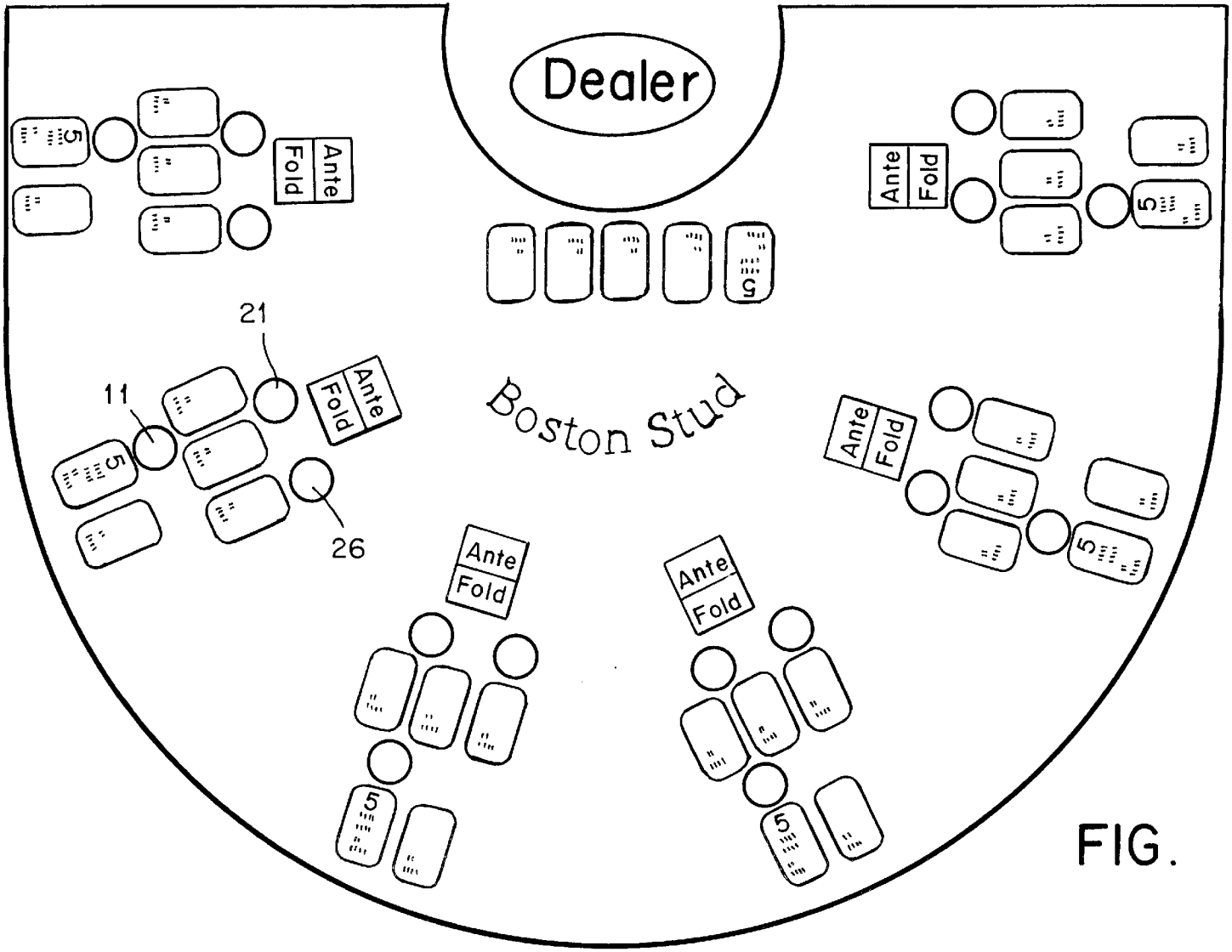
FIG. 3 is a game board layout of a five-card embodiment of the present invention.

FIGS. 3 and 4 illustrate a five-card version of this embodiment of the present invention which is played by similar rules to the embodiment described above except that upon placing a first wager in wager area 11, the player receives only two cards. Before receiving the player's third and fourth card, the player must place a second wager in the same amount in wager area 21. Similarly, before receiving the player's fifth and final card, the player must place a third wager in the same amount in wager area 26.

After all players have received their cards, the dealer reveals his/her cards and then collects losing wagers and provides winning payouts to winning players.

According to an alternative embodiment of the present invention, the amounts of the subsequent wagers are greater than the player's initial wager. For example, the subsequent wagers may increase in a progressive nature. FIGS. 5 and 6 illustrate wager amounts of this embodiment of the present invention wherein the player's second wager must be in an amount double the player's initial wager and the player's third wager must be an amount equal to triple the player's initial wager. In all other respects, this embodiment of the present invention is played by the same rules as the embodiments described above with respect to FIGS. 1 to 4. It will be appreciated that for this and all other embodiments of the present invention, the gaming establishment, dealer, and/or banker may set minimum and maximum amounts for the first wager or ante and the subsequent wagers may simply be multiples of the set amount. In all embodiments, once the player has placed a first wager, the value of subsequent wagers is set and cannot be changed during that hand. It will also be appreciated that if a banker is used in a gaming establishment, it is not necessary to rotate the deal among the players.

Figure 7:
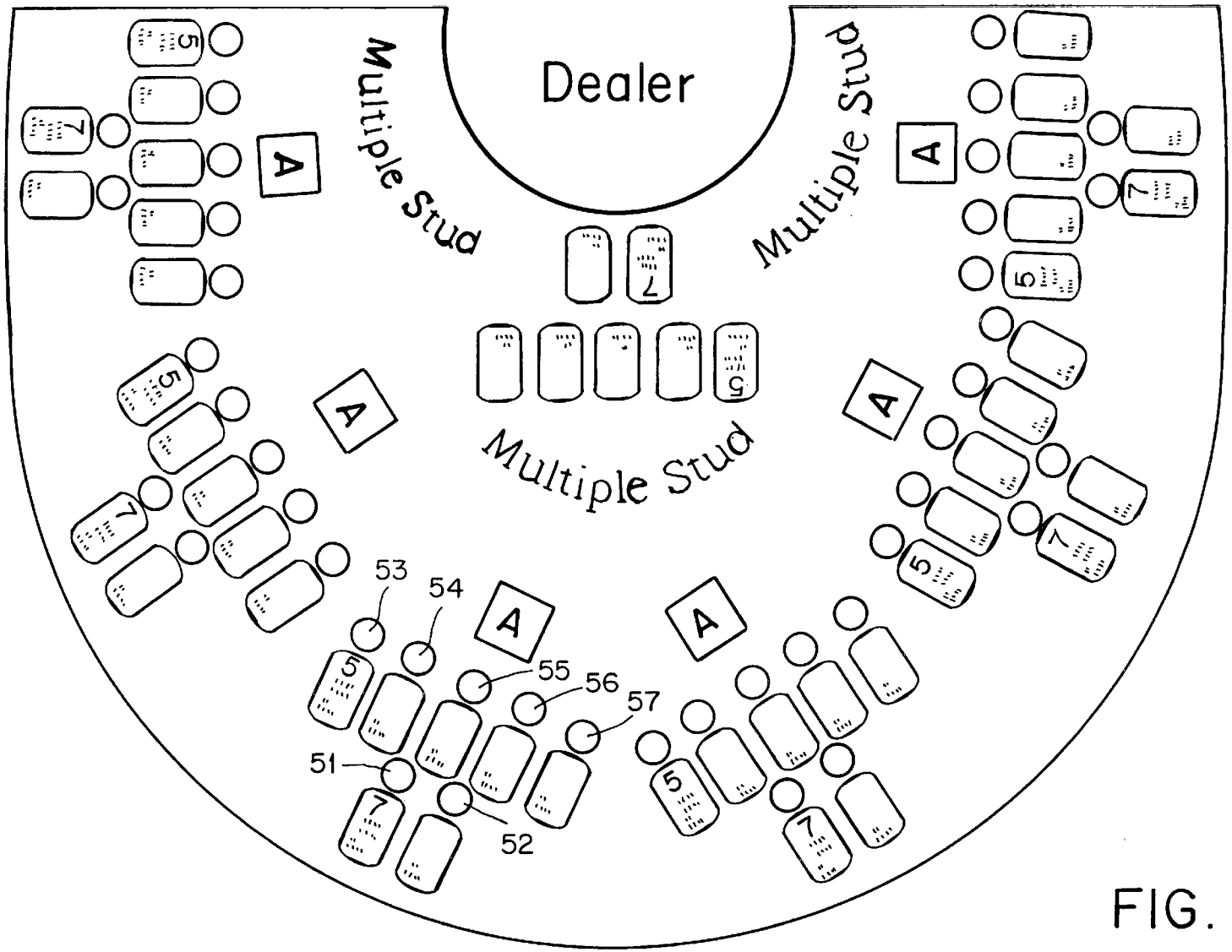
FIG. 7 is a game board layout of another alternative embodiment of the present invention.
Figure 8:
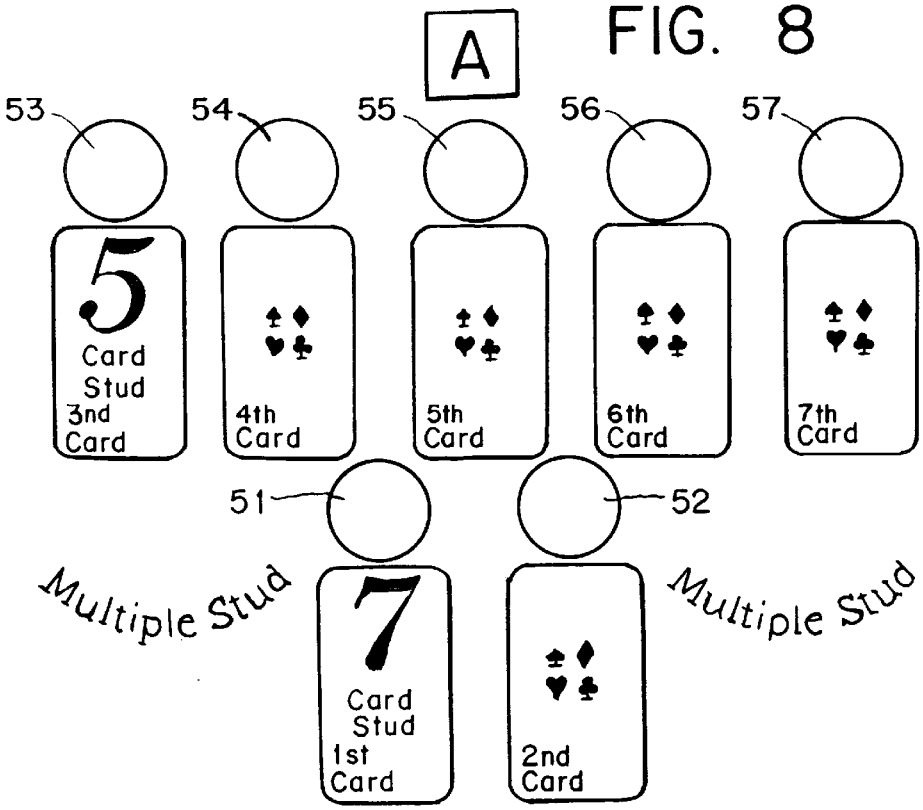
FIG. 8 illustrates a player's station of the embodiment illustrated in FIG. 7.

FIGS. 7 and 8 illustrate five-card and seven-card versions of an alternative embodiment of the present invention.

According to this embodiment, after play has started a player must place a wager of a predetermined value, relative to the player's first wager, in order to receive each subsequent card. According to the preferred table layout illustrated in FIG. 7, a single layout can be used for playing either the five-card version or the seven-card version of this game. If the player wishes to play the seven-card version, the first wager is placed in wager area 51. Players playing the seven-card version then must place wagers in each of wager areas 52 to 57 in order to remain in the hand. Alternatively, if a player desires to play the five-card version of this game, the player places his/her first wager in wager area 53 and then must place wagers in each of boxes 54 to 57 in order to remain in hand. Other indicia are provided on the game board in order to indicate where on the board the seven-card version and five-card versions start.

Figure 9:
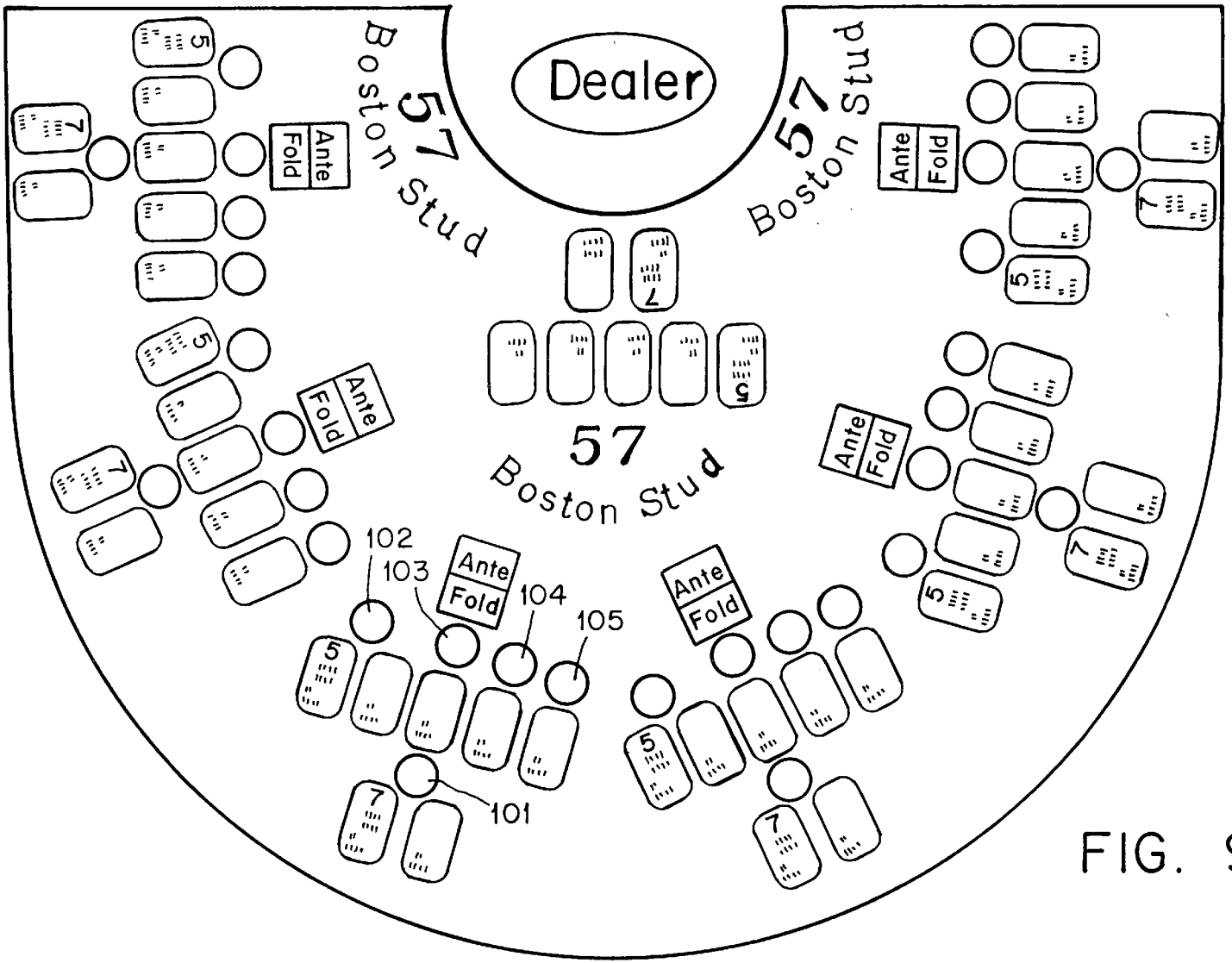
FIG. 9 illustrates a game board layout of a still further embodiment of the present invention.
Figure 10:
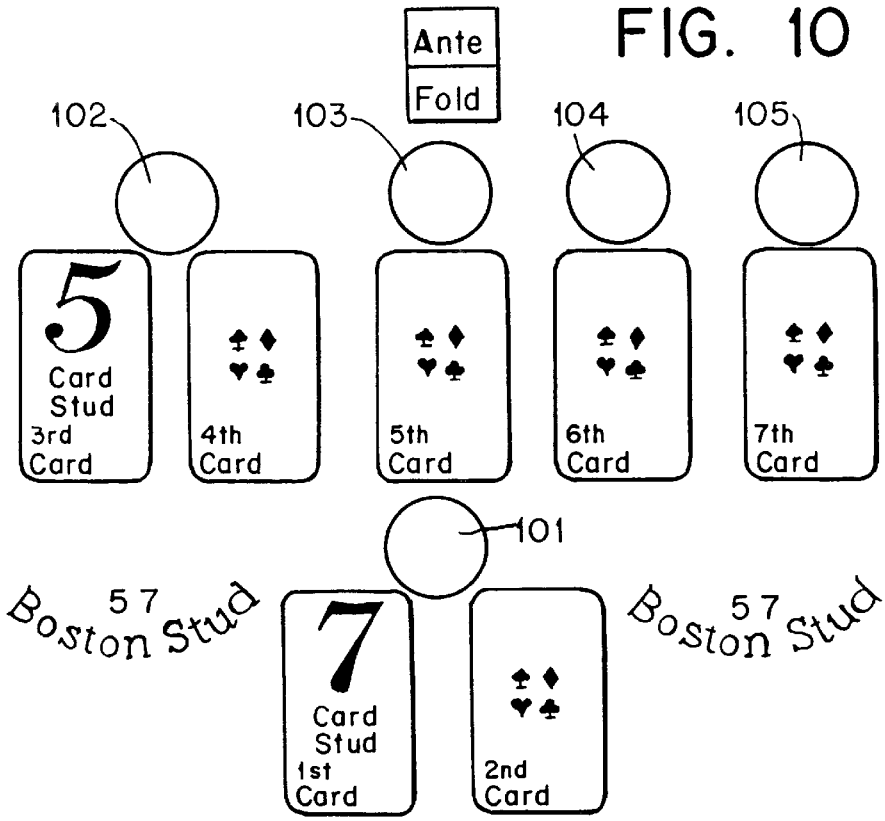
FIG. 10 illustrates a player's station of the embodiment illustrated in FIG. 9.

A still further embodiment of the present invention is illustrated in FIGS. 9 and 10 wherein a player is required to wager on each of the last three cards of a hand if the player wishes to stay in the hand. This embodiment is preferably played on a game board laid out in a fashion similar to the embodiment illustrated in FIGS. 7 and 8, except that the number of wagering areas is reduced. According to this embodiment of the present invention, before play begins, each player must place a first wager in wager area 101 if the player wishes to play the seven-card version of this game. After reviewing that player's first two cards, if the player wishes to continue, the player must then place a second wager in wager area 102 in order to receive two more cards. Each of the final three cards require subsequent wagers in wager areas 103 through 105. Alternatively, if the player wishes to play the five-card version of this game, the player places a first wager in wagering area 102 in order to receive an initial two cards. If the player wishes to continue, the player must place a second wager in wager area 103 before receiving the third card. Similarly, before receiving the fourth card, the player must place a wager in wager area 104 and subsequently a wager in wager area 105 if the player wishes to complete the hand by receiving the fifth card.

Figure 11:
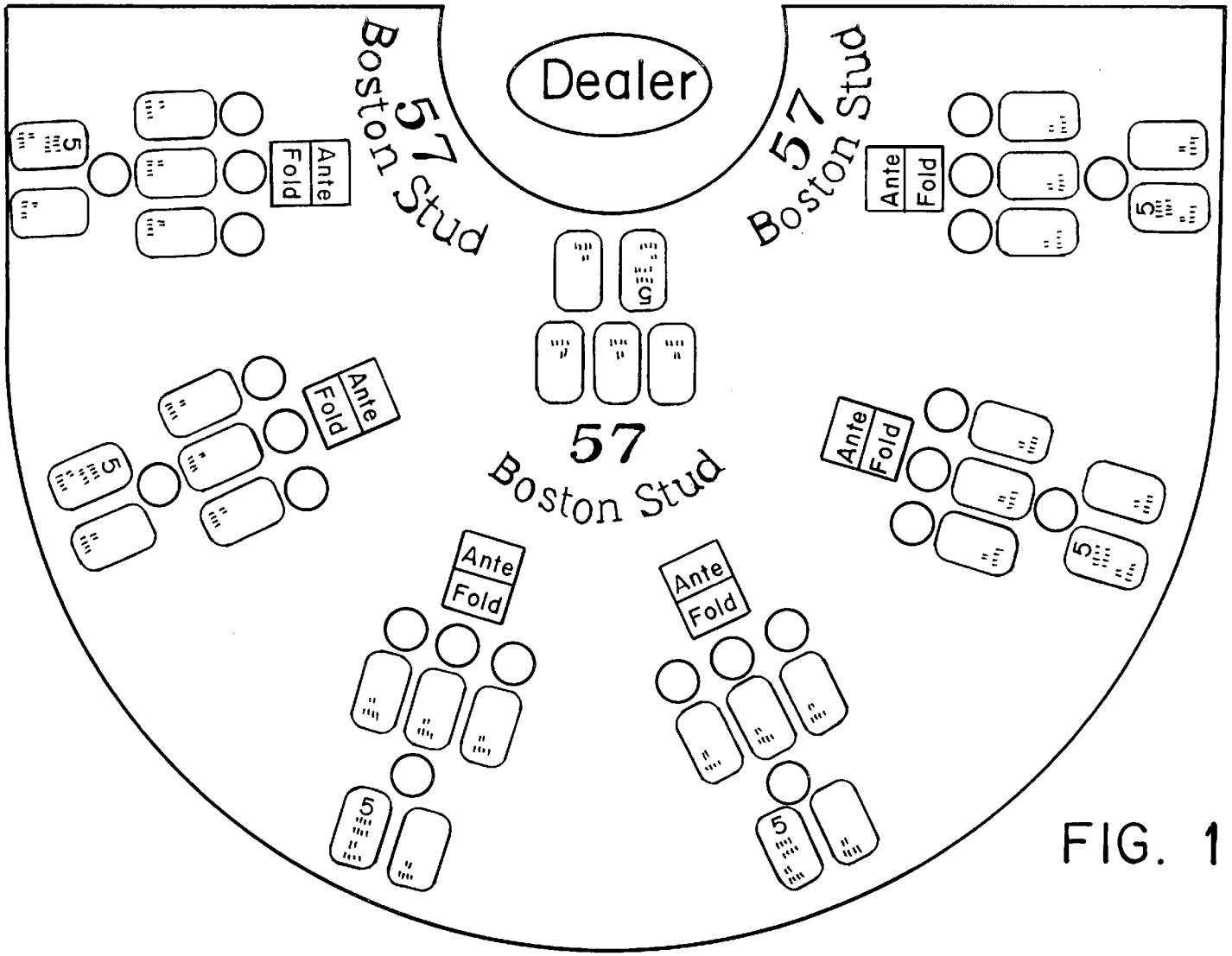
FIG. 11 is a game board layout of a still further embodiment of the present invention.
Figure 12:
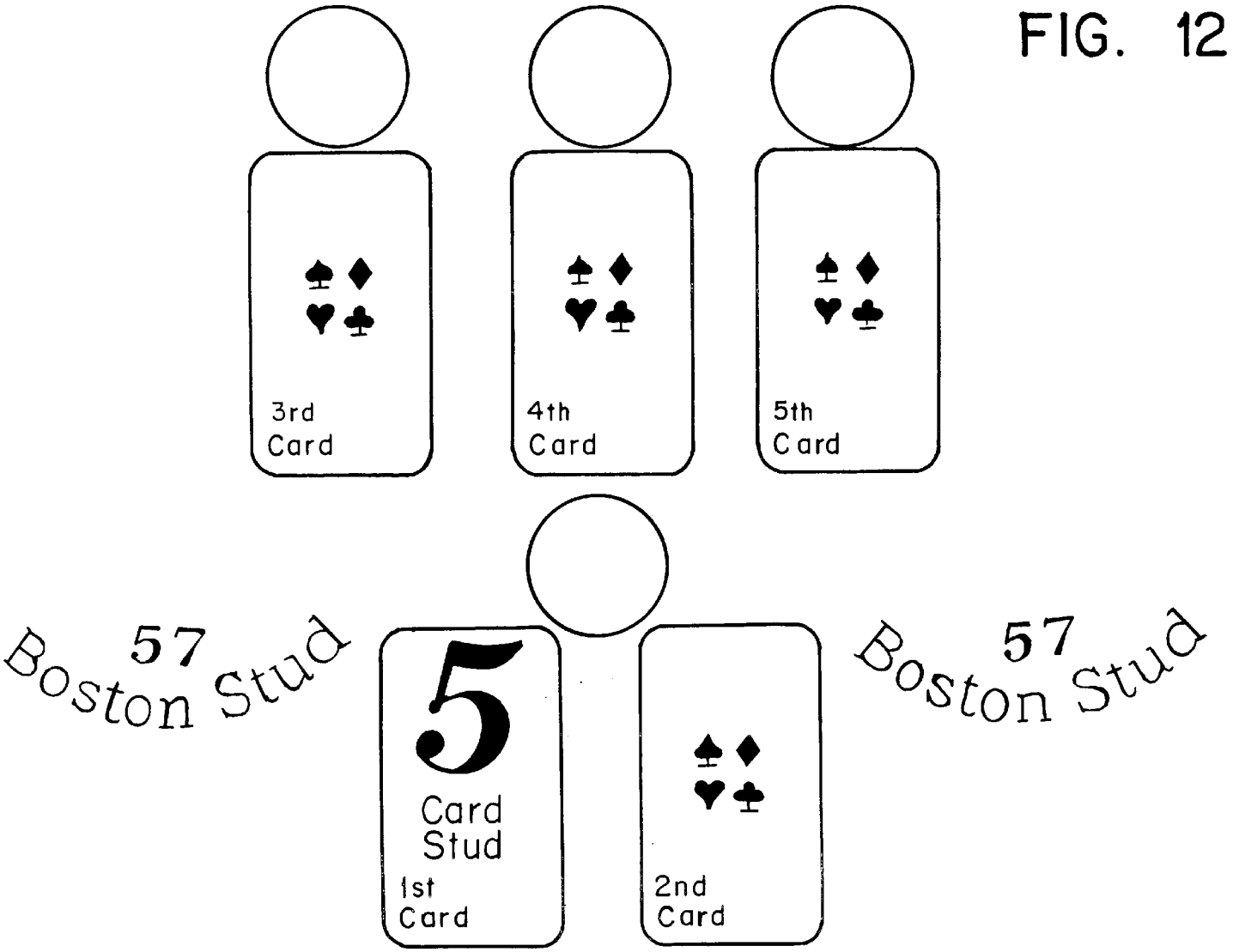
FIG. 12 illustrates a player's station of the embodiment illustrated in FIG. 11.

If the gaming establishment does not wish to provide players with the opportunity to play a seven-card version of the embodiment illustrated in FIGS. 9 and 10, a game layout of the type illustrated in FIGS. 11 and 12 can be utilized.

Figure 13:
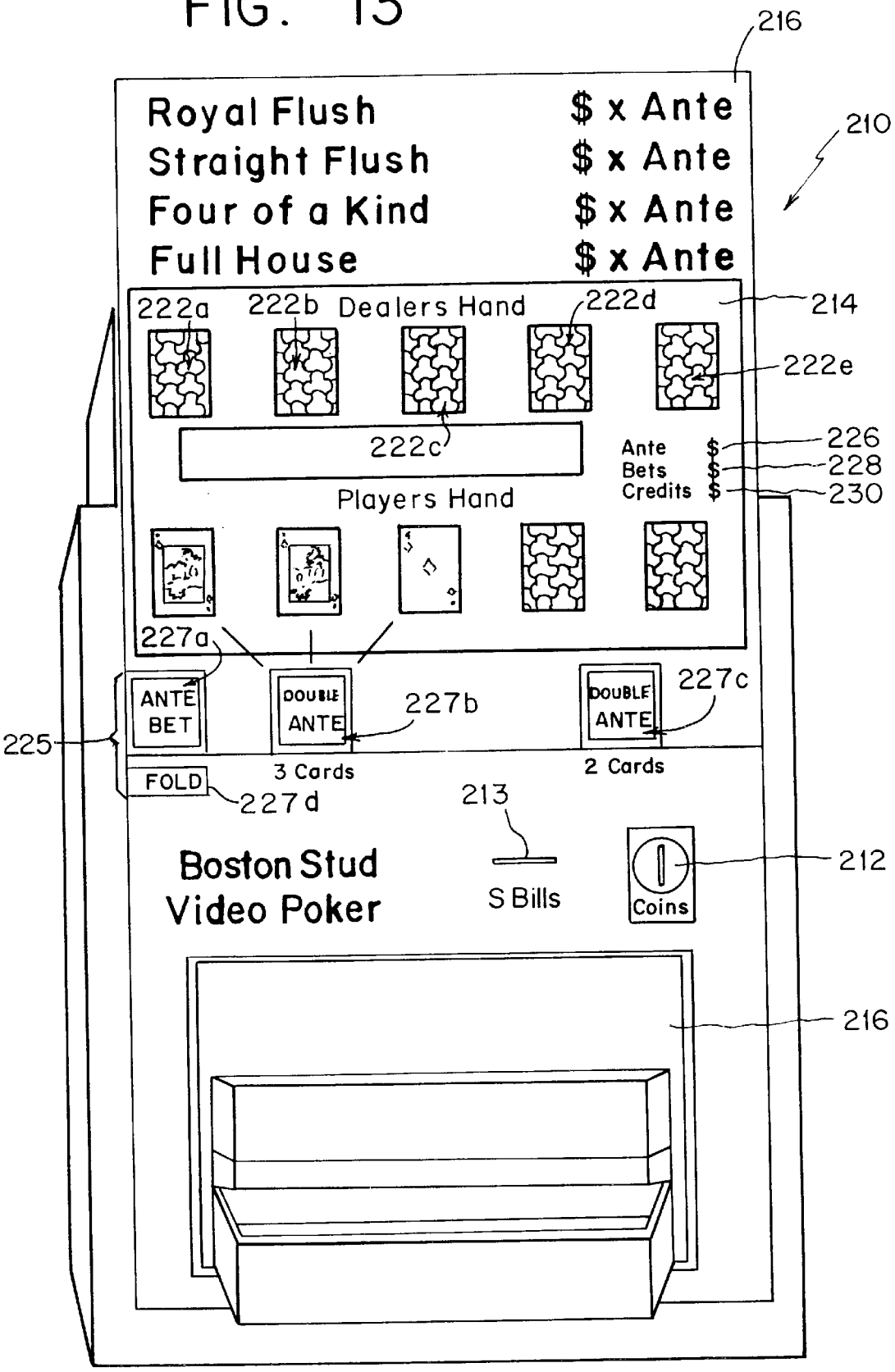
FIG. 13 shows an electronic five card version of the present invention.
Figure 14:
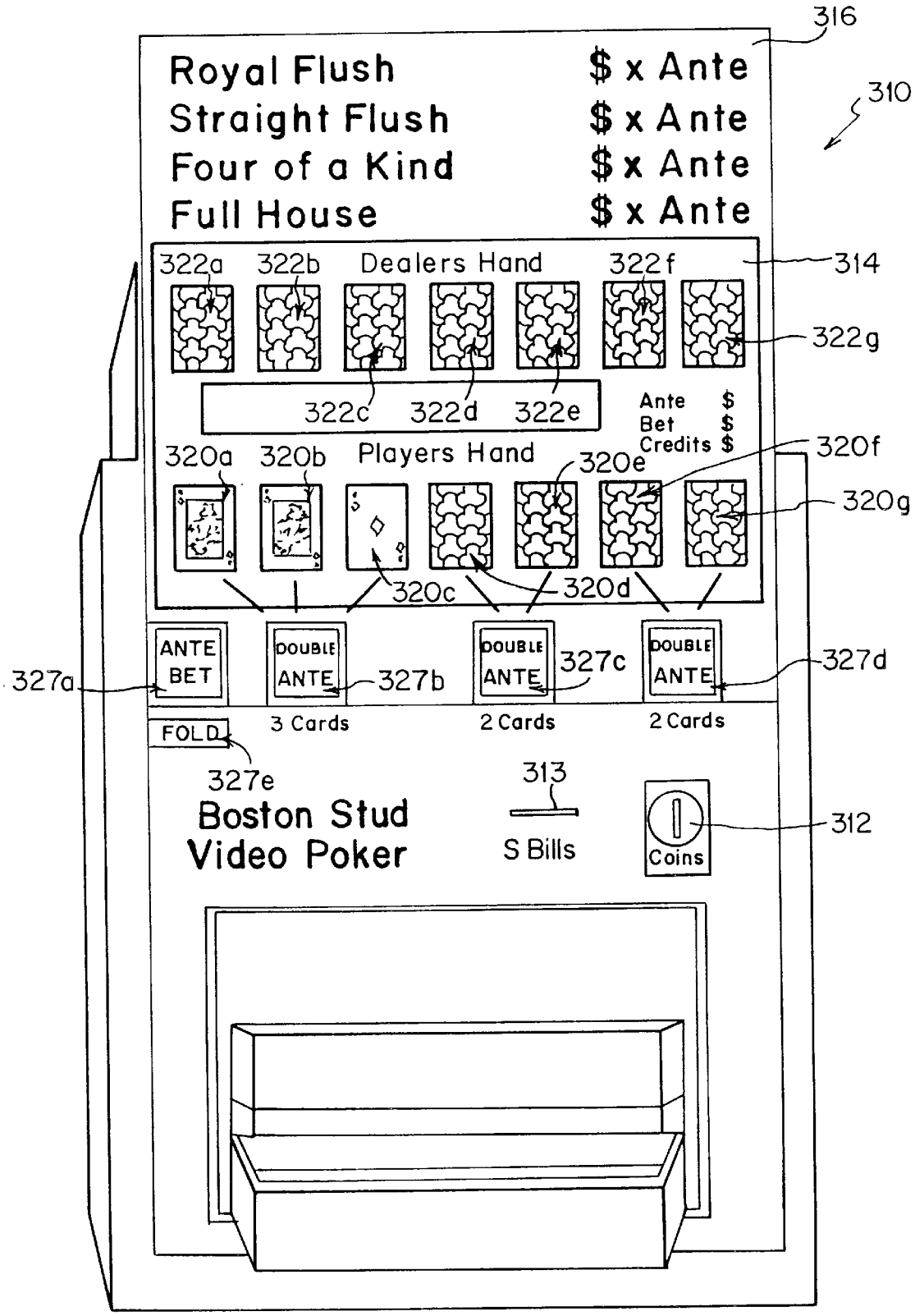
FIG. 14 shows an electronic seven card version of the present invention.

FIGS. 13 and 14 depict the game of the present invention as embodied in an electronic video apparatus. In particular, FIG. 13 shows a five-card version 210 and FIG. 14 shows a seven-card version 310. The five-card version 210 of FIG. 13 includes a video display panel 214, a mechanism for accepting wager amounts 213, 214, a mechanism for paying winnings to the player 216, and a player interface through which the player controls the progress of the game 225.

The typical video display panel 214 displays at least the dealer's hand 222*a*, 222*b*, 222*c*, 222*d* and 222*e*, the player's hand 220*a*, 220*b*, 220*c*, 220*d* and 220*e*, and the amount 228 currently wagered on the current game. Other items can be shown on the display panel depending upon the embodiment of the present invention being played. For example, if the video apparatus accepts money or its equivalent in amounts more than each wager or does not pay out winnings as cash or tokens, the amount of player's credit 230 remaining is displayed. The amount the player initially antes 226 can also be displayed on the video display 214. The dealer's and player's hand can be shown in several ways. In one way, all cards are shown face-down as place holders at the beginning of the game and, as the game progresses, the cards are changed to face-up as needed. In another, cards are only visible as they are needed in the course of the game; no cards are shown face-down as placeholders.

The wager accepting mechanism may be a coin slot 212, a bill validator 213, a credit/debit card reader (not shown), and/or any other mechanism that will accept money or monetary equivalents. In some gaming establishments, vouchers or debit cards are used in place of money or tokens. The player gives an amount of money, either to a cashier or to a machine, and, in return, receives a voucher or debit card worth the given amount. The voucher or debit card is then inserted into the wager receiving mechanism.

Winnings may be paid out in several ways, including as coins or tokens dropped by the video apparatus into a trough 216 or as amounts credited to the player within the video apparatus, which is converted to a voucher when the player is finished with the video apparatus. The voucher is then converted to cash or equivalent by a cashier.

The player interface 225 typically includes either buttons 227*a*, 227*b*, 227*c* and 227*d* on the video apparatus that the player depresses and/or locations on the display that the player touches. The interface includes, at a minimum, controls for starting a game and/or allowing an initial wager or ante 227*a*, folding or surrendering 227*d*, and continuing the game 227*b*, 227*c*. The start control may be a button 227*a* or touch location on the video apparatus, or it may be incorporated into a coin slot 212. For example, a coin inserted into the coin slot 212 is assumed by the video apparatus to start a new game. Likewise, the control for continuing a game 227*b*, 227*c* may be a button or touch location, or it may be incorporated into the coin slot by interpreting the next coin put into the slot as a next wager if the video apparatus is waiting for the player to decide whether or not to make the next wager. optionally, there is a separate button or touch location for each of the wagers allowed in the game, although, for example, the button 227*c* for the second wager will not be active until after the first wager is made. The fold or surrender control 227*d* is a button or touch location on the video apparatus.

The game is played on the video apparatus in essentially the same manner as described above. The five-card version 210 of FIG. 13 is typically played as follows. The game is started by the player activating the start control in whatever manner is dictated by the design of the particular video apparatus. The video apparatus reveals the first three of the player's cards 220*a*–220*c* on the display panel 214. If, after viewing the first three cards 220*a*–220*c*, the player does not wish to continue the game, the player activates the fold or surrender control 227*d* and the game is terminated, with the video apparatus retaining the amount wagered. If the player wishes to receive the next two cards 220*d* and 220*e*, he/she activates the continue control, again, in whatever manner is dictated by the design of the particular video apparatus. Once the hand is complete, the dealer's hand 222*a*–222*e* is revealed and the video apparatus may arrange the cards 222*a*–222*e* into the highest poker hand. The players hand 22*a*–220*e* is compared to the dealer's hand 222*a*–222*e*, and, if it is higher, the player is credited with an amount based upon the player's wagers for the game.

The seven-card version 310 of FIG. 14 is typically played as follows. The game is started by the player activating the start control. The video apparatus reveals the first three of the player's cards 320*a*–320*c* on the display panel 314. If, after viewing the first three cards 320*a*–320*c*, the player does not wish to continue the game, the player activates the fold or surrender control 327*e* and the game is terminated, with the video apparatus retaining the amount wagered. If the player wishes to receive the next two cards 320*d* and 320*e*, he/she activates the appropriate continue control 327*c*. If, after viewing the first five cards 320*a*–320*e*, the player does not wish to continue the game, the player activates the fold or surrender control 327*e* and the game is terminated, with the video apparatus retaining the total amount wagered. If the player wishes to receive the last two cards 320*f* and 320*g*, he/she activates the appropriate continue control 327*d*. Once the hand is complete, the dealer's hand 322*a*–322*g* is revealed and the video apparatus may arrange the cards 322*a*–322*g* into the highest poker hand. Optionally, the two cards that are not part of the highest poker hand are removed from the display panel 314. The player's hand 320*a*–320*g* is compared to the dealer's hand, and, if it is higher, the player is credited with an amount based upon the player's wagers for the game.

FIGS. 13 and 14 show the electronic video apparatus in the form of a large dedicated video machine similar to a slot machine such as would be found in a gaming establishment. Other forms of electronic video apparatus are also contemplated by the present invention. A personal computer can be programmed to play the game. A small hand-held device can be programmed or designed to play the game. The game can be played via a terminal connected to an on-line network, such as the Internet. In the on-line network form, it is possible that a plurality of players may participate in a single game. The game of the present invention can also be embodied in an electronic apparatus for use on an airplane for those airlines provide gambling opportunities when flying over international waters or nations that allow it. Optionally, the video apparatus is equipped to include any or all of the jackpots and bonus awards described below.

From the present description, it will be appreciated that the present invention provides players with numerous wagering opportunities requiring numerous decisions on the part of each player. The amounts of wagers following the first wager are fixed relative to the first wager and must be placed in order for the player to remain in a given hand.

The various embodiments of the present invention also provide players with the ability to play poker-type games in a casino setting against one person, i.e., the dealer, rather than playing in a group with each player playing against other players. It also allows a player to play one on one with the dealer and does not require a full complement of players in order to play the game. Other embodiments such as those illustrated in FIGS. 13 and 14 are preferably designed for one player. However, in some cases it may be preferable to use one electronic version of the present invention with a plurality of players who can simultaneously play the same or a different embodiment of the present invention with the dealer. In other embodiments played with multiple players, the players are not required to wager the same amounts.

The various embodiments of the present invention include an "ANTE" wager area. The ANTE can be used for any of a number of purposes. (1) It can be returned to the winning player. (2) It can be used as a vigorish to provide the gaming establishment or banker with a house advantage or with a guaranteed source of revenue that is independent of the amount of losing wagers collected. (3) It can be used as the basis for a match or tough beat jackpot, as described below, or for a fixed bonus award. (4) It can be used to provide the gaming establishment with a guaranteed source of revenue if the gaming establishment provides facilities to the players but does not participate in the game. An alternative to this is for the game participants to pay the gaming establishment an hourly rate for the use of the facilities.

The preferred layouts of the present invention also advantageously indicate the positions where cards are to be placed and other indicia indicate the number of cards that a player will receive upon placing a specified wager.

As mentioned above, the various embodiments of the present invention may be combined with other wagering options or bonuses. For example, players may automatically qualify for a fixed bonus award or progressive jackpot simply by participating in one of the games of the present invention. According to one preferred embodiment, players are provided with a bonus award if their hands match the dealer's hand. It is also within the scope of the present invention to provide a bonus award to players receiving certain predetermined hands, for example, a royal flush. Optionally, the players pay for the privilege of receiving a bonus award by wagering a predetermined side amount prior to commencement of the game.

Optionally, a match jackpot may be played as an adjunct to the game. This jackpot is won when there are at least two hands having the same winning combination. Prior to the beginning of play, the gambling establishment determines how close two hands must be to qualify as having the same winning combination. For example, all straights may have the same rank or only straights with the same highest card may have the same rank.

Optionally, a tough beat jackpot may be played as an adjunct to the game. This jackpot is won when a ranked hand is beaten by another hand with a higher ranking. The house will determine which ranked hands are eligible for the tough beat jackpot prior to beginning game play.

If either the match jackpot or tough beat jackpot are offered, playing them is optional and one or both may be played by a player. Those players that do not choose to play either jackpot may still play the game. It is optional with the gambling establishment whether to allow either jackpot to be played without also playing the game.

A jackpot may be "set" or "progressive". In a set jackpot, the amount put into the jackpot for each game is fixed, but the fixed amount may be adjusted periodically, for example, after the jackpot is won. In a progressive jackpot, the amount put into the jackpot increases for each jackpot, and the amount put into the jackpot increases for each game played during which the jackpot is not won. There may be a set jackpot, a progressive jackpot, or both for each of the match and tough beat jackpots. Preferably, intention to play a jackpot is indicated by placing a wager in one or more of special locations on or near the playing surface. For example, there are separate locations on the playing surface for the match set, match progressive, tough beat set, and tough beat progressive jackpot wagers.

Only those players who wager a predetermined amount on a jackpot before a game are eligible to win that jackpot on the completion of that game. If more than one eligible player wins a set jackpot, each winner is paid a predetermined amount. If more than one eligible player wins a progressive jackpot, its value is divided equally among the players.

Optionally, the jackpot wagers of each type from more than one gaming table are linked, that is, they are combined into one jackpot which can be won by anyone at any of the linked tables.

Optionally, rather than being played on a table surface with a live dealer, the game is played on a video machine, a personal computer, a slot machine, over an on-line computer network, or on another type of one-way or interactive gaming or entertainment equipment as described above. Optionally, the game can also be played using scratch tickets and pull tabs.

Optionally, while it is preferable to utilize five or seven cards with the present invention, in some cases it may be desirable to utilize more or fewer cards, or perhaps, to allow a player to choose a specific number of his or her best cards from a larger hand to play the game, e.g., best five cards out of an eight card hand.

Optionally, other bonuses may be awarded as well. In one embodiment, if the player gets a predetermined ranked hand (either a standard poker ranking or other predetermined ranking) the player can be awarded a bonus based upon the ranking of his/her hand in combination with the amount of his/her ante and/or amount of the total wager. For example, if the player has a straight and had placed an ante of $2.00 but eventually loses to the dealer, the player may be awarded $3.00, 1.5 times his $2.00 ante. A player may also receive a bonus payment if the player wins and has a ranked hand. Further, the multiple used can vary with the ranking of the player's losing hand.

Furthermore, if the rules allow, a player may elect to use a partial hand for the bonus. For example, rather than have the bonus paid if the complete hand qualifies as one of the predetermined bonus hands, a hand composed of the second, third, fourth, and fifth cards can be paid a bonus if it qualifies. This also means that if a player folds after viewing the first three cards, the incomplete three-card hand can be used to receive a bonus payout if it qualifies.

What is claimed is:

1. An apparatus for playing a card game comprising:

means for receiving at least one initial wager;

means for providing a dealer with a plurality of cards face down;

means for displaying at least one card to said player to form an initial partial hand;

means for subsequently requiring said player to place a second wager in an amount related to said initial wager by a predetermined multiple in order to continue playing said hand;

wherein said displaying means displays at least one additional card to said player if said player increases said player's initial wager by said predetermined amount; and means for comparing said dealer's hand with said player's hand according to a predetermined poker ranking and determining winning payouts based upon said comparison.

2. An apparatus according to claim 1 wherein said wager requiring means requires said player to make a third wager in order to complete said hand.

3. An apparatus according to claim 1 wherein said wager requiring means requires said player to make a wager before each card is shown to said player subsequent to said player's receipt of said initial partial hand.

4. An apparatus according to claim 1 wherein said wager requiring means requires said player to make a wager prior to being shown each of three last cards displayed to said player, in order to complete playing said hand.

5. An apparatus according to claim 1 further comprising means for more than one player to play said game.

6. An apparatus according to claim 1 wherein said displaying means displays said additional card in a face-up position.

7. An apparatus according to claim 1 wherein said displaying means displays said additional card in a face-down position.

8. An apparatus for playing a card game comprising:

means for receiving at least one initial wager from a first player and means for receiving at least one initial wager from a second player;

means for providing a dealer with a plurality of cards face down;

means for displaying at least one card to said first player to form an initial partial hand;

means for subsequently requiring said first player to place a second wager in an amount related to said first player's initial wager by a predetermined multiple in order to continue playing said hand;

wherein said displaying means displays at least one additional card to said first player if said first player increases said first player's initial wager by said predetermined amount;

means for displaying at least one card to said second player to form an initial partial hand;

means for subsequently requiring said second player to place a second wager in an amount related to said second player's initial wager by a predetermined multiple in order to continue playing said hand;

wherein said displaying means displays at least one additional card to said second player if said second player increases said second player's initial wager by said predetermined amount;

wherein said first hand and said second hand have different numbers of cards; and means for comparing said dealer's hand with said players' hands according to a predetermined poker ranking and determining winning payouts based upon said comparison.

9. An apparatus according to claim 8 wherein said displaying means displays five cards to form a complete hand and displays seven cards to form a complete second hand.

10. An apparatus according to claim 1 further comprising means for providing a game display comprising indicia of the number of cards that a player may elect to receive.

11. An apparatus according to claim 1 further comprising means for providing a game display comprising indicia of the number of wagers that a player must place in order to remain in a hand.

12. An apparatus according to claim 8 further comprising means for providing a game display comprising indicia of the number of additional cards that a player can receive by placing an additional wager.

13. An apparatus according to claim 1 wherein said wagering means requires a player to place wagers of successively greater amounts in order to remain in a hand.

14. An apparatus according to claim 1 further comprising means for providing a player with the chance to win an enhanced payout.

15. An apparatus according to claim 14 wherein said providing means for providing a player with a chance to win an enhanced payout increases the enhance payout in a progressive manner until a player wins said enhanced payout.

16. An apparatus according to claim 8 wherein said displaying means displays said additional card in a face-up position.

17. An apparatus according to claim 8 wherein said displaying means displays said additional card in a face-down position.

18. An apparatus for playing a card game comprising:

means for starting a hand by receiving at least one initial wager;

means for providing a dealer with a plurality of cards face down;

means for displaying at least one card to said player to form an initial partial hand;

means for subsequently requiring said player to place a second wager in an amount related to said initial wager by a predetermined multiple in order to continue playing said hand;

wherein said displaying means displays at least one additional card to said player if said player increases said player's wager by said predetermined amount;

means for providing a player with a chance to win an enhanced payout wherein a player's hand must match the dealer's hand for player to win said enhanced payout; and means for comparing said dealer's hand with said player's hand according to a predetermined poker ranking and determining winning payouts based upon said comparison.

19. An apparatus according to claim 18 wherein said displaying means displays said additional card to said player in a face-up position.

20. An apparatus according to claim 18 wherein said displaying means displays said additional card to said player in a face-down position.

21. An apparatus for playing a card game comprising:

means for starting a hand by receiving at least one initial wager;

means for providing a dealer with a plurality of cards face down;

means for displaying at least one card to said player to form an initial partial hand;

means for subsequently requiring said player to place a second wager in an amount related to said initial wager by a predetermined multiple in order to continue playing said hand;

wherein said displaying means displays at least one additional card to said player if said player increases said player's wager by said predetermined amount;

means for providing a player with a chance to win an enhanced payout wherein the amount of said enhanced payout will be different for different numbers of cards in said player's complete hand; and means for comparing said dealer's hand with said player's hand according to a predetermined poker ranking and determining winning payouts based upon said comparison.

22. A method of playing a card game comprising the steps of:

requiring at least one player to make at least one initial wager;

providing a player and a dealer with at least one card each to form initial partial hands;

subsequently requiring said player to place a second wager in an amount related to said initial wager by a predetermined multiple but unrelated to the amounts of the wagers of other players in order to continue playing said hand;

providing said player and said dealer with at least one additional card each if said player increases said player's initial wager by said predetermined amount wherein different players are not required to wager the same amount; and comparing said dealer's hand with said player's hand according to a poker ranking and determining winning payouts based upon said comparison.

23. A method of playing a card game comprising the steps of:

requiring at least one player to make at least one initial wager;

providing a player with at least one card to form an initial partial hand;

providing a dealer with a plurality of cards face down;

subsequently requiring said player to place a second wager in an amount related to said initial wager by a predetermined multiple but unrelated to the amounts of the wagers of other players in order to continue playing said hand;

providing said player with at least one additional card if said player increases said player's initial wager by said predetermined amount wherein different players are not required to wager the same amount;

comparing said dealer's hand with said player's hand according to a poker ranking and determining winning payouts based upon said comparison; and providing a bonus payment to said player if said player loses to said dealer, said bonus payment based upon a predetermined ranking of said player's hand and said initially wagered amount.

24. A method of playing a card game according to claim 23 wherein said bonus payment is based upon a predetermined ranking of said player's hand and a multiple of said ante.

25. An apparatus for playing a card game comprising:

means for receiving at least one initial wager;

means for providing a dealer with a plurality of cards face down;

means for displaying at least one card to said player to form an initial partial hand;

means for subsequently requiring said player to place a second wager in an amount related to said initial wager by a predetermined multiple in order to continue playing said hand;

wherein said displaying means displays at least one additional card to said player if said player increases said player's initial wager by said predetermined amount;

means for comparing said dealer's hand with said player's hand according to a predetermined poker ranking and determining winning payouts based upon said comparison; and means for providing a bonus payment to said player based upon a predetermined ranking of said player's hand and a multiple of said initially wagered amount.

26. A apparatus according to claim 25 wherein said means for providing a bonus payment provides said bonus payment based upon a predetermined ranking of said player's hand and a multiple of said ante.

* * * * *